US006349432B1

(12) United States Patent
Scordato et al.

(10) Patent No.: US 6,349,432 B1
(45) Date of Patent: Feb. 26, 2002

(54) METHOD AND APPARATUS FOR PATIENT TRANSFER

(75) Inventors: Emil A. Scordato, Eastchester, NY (US); George Assoian, Oldsmar, FL (US); Ken Bussey, Safety Harbor, FL (US); Floyd E. Roberts, Treasure Island, FL (US)

(73) Assignee: MLA Stretchair, Largo, FL (US)

( * ) Notice: Subject to any disclaimer, the term of this patent is extended or adjusted under 35 U.S.C. 154(b) by 0 days.

(21) Appl. No.: 09/438,904

(22) Filed: Nov. 12, 1999

Related U.S. Application Data

(60) Provisional application No. 60/108,545, filed on Nov. 16, 1998.

(51) Int. Cl.[7] ..... A61G 7/14
(52) U.S. Cl. ..... 5/81.1 R; 5/81.1 HS; 5/926
(58) Field of Search ..... 5/81 R, 81.1 HS, 5/81.1 C, 81.1 T, 89.1, 926

(56) References Cited

U.S. PATENT DOCUMENTS 3,329,978 A * 7/1967 Porter et al. ..... 5/81.1 R
3,769,642 A * 11/1973 Warman ..... 5/81.1 T
3,829,914 A * 8/1974 Treat ..... 5/81.1 T
4,361,918 A * 12/1982 Roisaeth ..... 5/81.1 T
4,744,115 A * 5/1988 Marchione ..... 5/891.1 T
5,148,558 A * 9/1992 Dunn ..... 5/81.1 T
RE35,468 E * 3/1997 Newman ..... 5/81.1 R
5,642,537 A * 7/1997 Johnson ..... 5/81.1 HS
5,860,174 A * 1/1999 Failor ..... 5/926 X
5,933,884 A * 8/1999 Shikinami et al. ..... 5/81.1 R

* cited by examiner

*Primary Examiner*—Michael F. Trettel
(74) *Attorney, Agent, or Firm*—Wolf, Greenfield & Sacks P.C.

(57) ABSTRACT

This invention provides methods and apparatus for moving or transferring a prone person or other body between two platforms, permitting a single caregiver of less than average strength to perform such transfer between an unmodified bed and a second surface, which may for example be part of a transport device. The method involves providing some form of low friction surface over any significant portion of a bed or other platform over which the person or other body is to be moved, the person either being mounted on a low friction board or sheet having straps extending therefrom to facilitate movement of the person across a first platform to a second platform, which is preferably mounted at a slightly lower height than the first one, or straps being wrapped around the person at two spaced locations and used for pulling the patient across the low friction surface to effect the transfer. The invention also includes low friction transfer boards, low friction sheets and special straps adapted for practicing the above methods.

17 Claims, 12 Drawing Sheets

METHOD AND APPARATUS FOR PATIENT TRANSFER

PRIOR APPLICATION

Figure 1A:
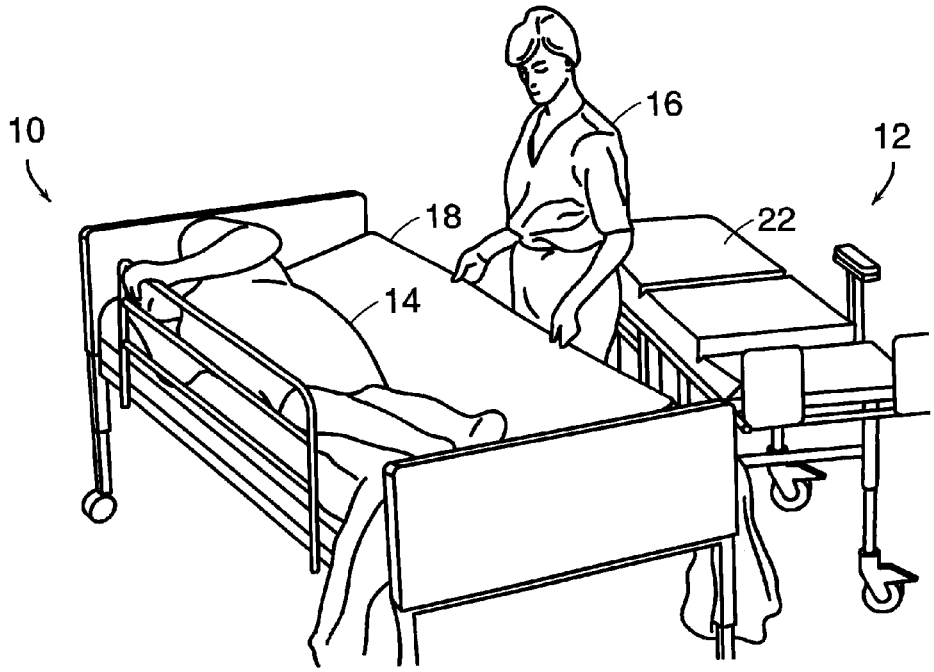
Figure 1B:
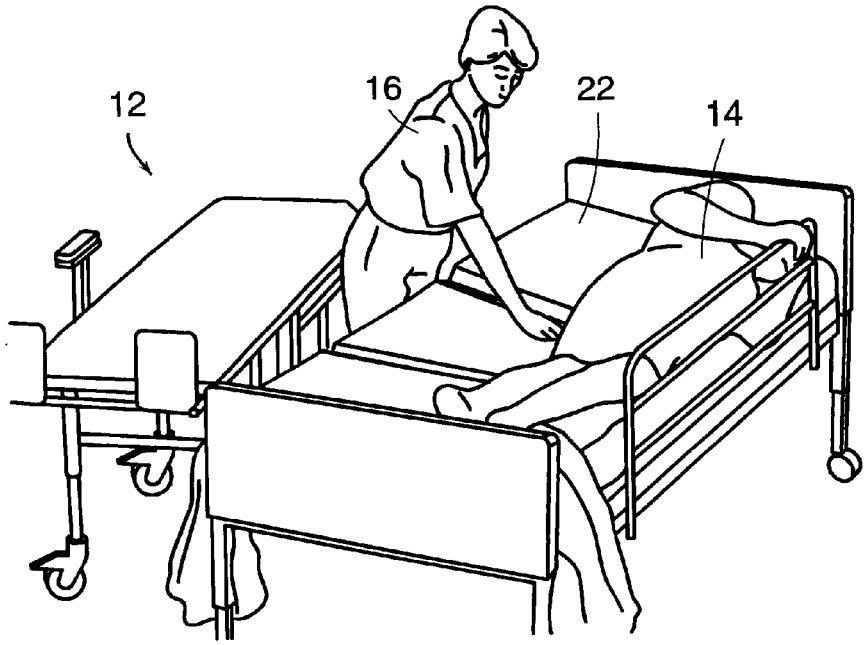
Figure 1C:
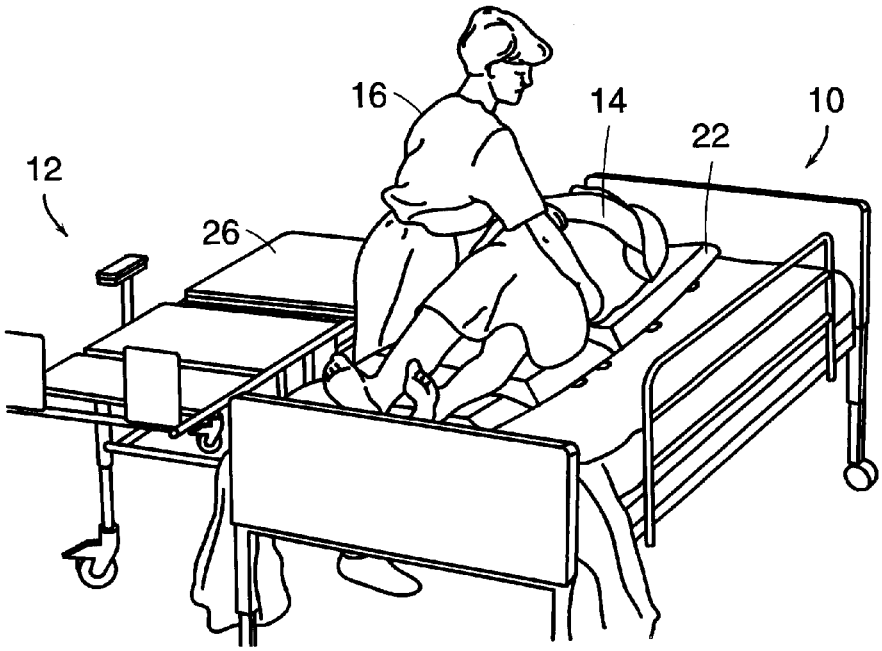

This application claims priority from Provisional Application No. 60/108,545, filed Nov. 16, 1998, now lapsed the contents of which are incorporated herein by reference.

FIELD OF THE INVENTION

This invention relates to methods and apparatus for moving or transferring a prone patient or other body between two platforms, and more particularly to a method and apparatus for permitting a single caregiver of less than average strength to transfer an infirm or disabled patient between an unmodified bed or other surface on which the patient is lying and a second surface which is preferably part of a transport device.

BACKGROUND OF THE INVENTION

Care of the aged and infirm is, in most cases, initially provided by family, loved ones, and close friends until the burden of care becomes too much and care giving services are taken over by nursing homes and other managed care facilities. Because of the importance of this care, society has attempted to defray the resulting costs with public and private sector programs for the elderly and the sick. The difference in cost, however, between care given at home, and care given at a facility, is enormous. Often the home based care giver for an infirm individual is also elderly or of reduced physical capacity. If the burden on the home based care giver is reduced, the length of time before facility care is required may be dramatically extended. This would provide a better quality of care and a better quality of life for the patient, as well as reduce overall health care costs to society.

One of the most basic of tasks is that of getting a person out of bed and into a mobile chair or other mobile conveyance so that they can participate in digestive, social, and hygienic activities. These basic activities greatly increase the sense of independence and the quality of life for a home bound patient. Previously, the primary means of accomplishing this task was using a patient lift. This is basically a sling supported from a hoist such as is used to lift automobile engines. These prior art devices are cumbersome to maneuver in the home, uncomfortable for the patient to remain in for any period of time, and extremely costly. Other prior art devices include a plethora of reclinable chairs and bed-to-stretcher transfer devices; however, all suffer from limitations of distance over which the patient may be transferred, and none address a principal problem of high frictional loads from the bed to a transfer element caused by the patient's weight.

Problems similar to those indicated above also arise in various facilities providing care for the elderly and infirm, including hospitals, nursing homes, rehabilitation facilities, and the like. Since most moving of patients in such facilities is performed by nurses and aides, most of whom are women of limited strength, and since at facilities such as nursing homes, large numbers of patients must be moved, often several times during each day, two or three caregivers are often required to move a large patient, and back problems are an occupational hazard for caregivers at these facilities.

A need therefore exists for relatively inexpensive apparatus which can be utilized in an improved method to permit a single caregiver of even below average strength to be able to move most patients between a first platform or surface, which may for example be a bed on which the patient is lying, and a second platform or surface, which may be part of a transport device, without any need to lift the patient or to perform other maneuvers which might risk back injury or impose other undue strain on the caregiver.

SUMMARY OF THE INVENTION

In accordance with a first aspect, this invention provides, a method for transferring a person lying on a first platform of a selected height to a second platform of a height no higher than that of the first platform. The method includes (a) mounting a low friction surface on the first platform over at least most of the portion of the first platform between the person and a first side of the first platform over which the transfer will occur, at least some portion of the low friction surface extending under the person; (b) providing at least two spaced straps extending in a first direction from the person toward the first side of the first platform and linked to the person in a manner such that movement of the straps in the first direction results in a corresponding movement of the person in such direction; (c) pulling the straps in the first direction to move the person over the low friction surface to the first side of the platform; (d) moving the second platform adjacent the first side of the first platform, step (d) being performed either before or after step (c); and (e) continuing to pull on the straps from a side of the second platform opposite that adjacent the first platform to move the person from the first platform to the second platform. For preferred embodiments, the low friction surface on the first platform is either a slide sheet or a slide board (hereinafter sometimes called "slide sheet/board"). A board having a low friction bottom surface may normally form the top surface of the second platform, with the straps being attached to this board and extending in the first direction therefrom. In this case, step (b) includes moving this board from the second platform to the first platform over the slide sheet/board, and log rolling the person onto this board, the board with the person thereon being moved during steps (c) and (e). Alternatively, the straps may extend from the slide sheet/board, in which case step (b) includes log rolling the person onto the slide sheet/board and steps (c) and (e) include moving the slide sheet/board with the person thereon. Another option is for step (b) to include placing a second slide sheet/board over the initial slide sheet/board and log rolling the person onto the second slide sheet/board, steps (c) and (e) including moving the second slide sheet/board with the person thereon. Still another option is for step (b) to include wrapping the straps around the person at two or more space locations along the person, steps (c) and (e) in this case including using the straps to pull the person. At some point in the method before step (e), it is preferable that the height of at least one of the platforms be adjusted so that the second platform is slightly lower than the first platform, this difference in height being approximately 1 inch to 2 inches for preferred embodiments.

The invention also includes a method of transferring a person lying on a first platform of a selected height to a second platform of a height no higher than that of the first platform which method includes (a) providing a low friction surface under the person for at least a portion of the travel path of the patient between the person's initial position on the first platform and the person's desired final position on the second platform, the low friction surface being under the person for at least any extended portion of the travel path where the person is over a platform; (b) providing at least two spaced straps extending in a first direction from the person toward the second platform and linked to the person in a manner such that movement of the straps in the first direction results in a corresponding movement of the person in the first direction; (c) moving the second platform adjacent the first platform, this step (c) being performed at a point in the method prior to step (d); and (d) pulling on the straps in the first direction from a side of the second platform opposite that adjacent the first platform to move the person from the first platform to the desired final position on the second platform. At a point in the method prior to step (d), the height of at least one of the platforms should be adjusted so that the second platform is slightly lower than the first platform, for example approximately 1 inch to 2 inches. Step (a) may include positioning the person on a board having a low friction surface on its side opposite that on which the person is positioned, step (b) in this case including providing straps fixed to and extending from such board. Step (a) may also include mounting a low friction surface on at least one of the platforms for the portion of the travel path of step (a). Alternatively, step (a) may include positioning the person on a slide sheet having a low friction surface on its side opposite that on which the person is positioned, step (b) in this case including providing straps fixed to and extending from such sheet. Step (a) in this case may also include mounting a low friction surface on at least one of the platforms for the portion of the travel path. Another option is for step (a) to include mounting a low friction surface on at least one of the platforms for the portion of the travel path, in which case, step (b) includes wrapping the straps around the person at two or more spaced locations along the person.

The invention also includes a slide board for use in moving a person lying on a first platform to a second platform, the slide board being substantially flat, having at least one low friction surface, being of a length at least as great as the height of a majority of persons with whom the board will be used, having a width to cover the distance over which a person is to be moved on one of said platforms, and having at least one projection positioned to fit under a substantially non-weight bearing area of a prone person. For an illustrative embodiment, the projections fit under the head and feet areas of the person. The board may also be bendable at least two places along its length for various reasons including storage.

The invention also includes a strap for use in moving a person from a first platform to a second platform, the strap including a body portion having a length greater than the maximum circumference of a normal person to be moved, a first width and a plurality of holes formed near one end thereof, which holes have a selected width and are aligned along the length of the body; and a handle portion extending from the end of the body portion opposite the end thereof with the holes, the handle portion having a width less than the selected width of the holes, being secured to the body portion on one end thereof and having a handle formed therein at the opposite end thereof. The handle portion may include a strap which passes over the body portion for a selected length, is looped to form the handle and extends back under the body portion for the selected length, the selected lengths of strap over and under the body portion being sewn to the body portion to secure the strap thereto. A loop may also be secured to the body portion in the area of the selected length of strap.

Finally, the invention includes a slide sheet for use in moving a person lying on a first platform to a second platform, the sheet having at least one low friction surface, being of at length at least as great as the height of a majority of persons with whom it will be used, having a width to cover a distance over which a person is to be moved on one of the platforms and having at least two spaced hand straps extending from at least one side thereof. The sheet may also include a plurality of finger pockets formed on a side of the sheet opposite a side from which the straps extend, the pockets being positioned to facilitate.

The foregoing and other objects, features and advantages of the invention will be apparent from the following more particular description of preferred embodiments as illustrated in the accompanying drawings.

IN THE DRAWINGS

Figure 2A:
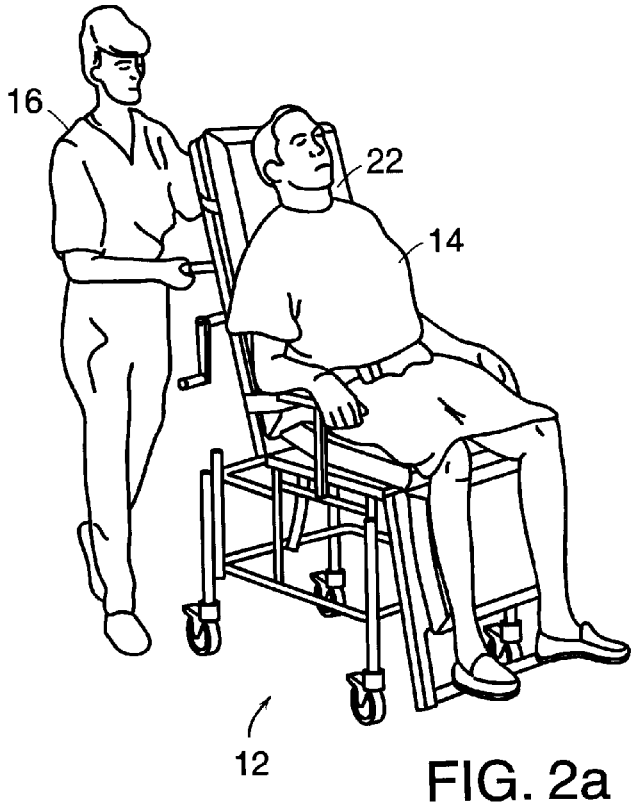
Figure 2B:
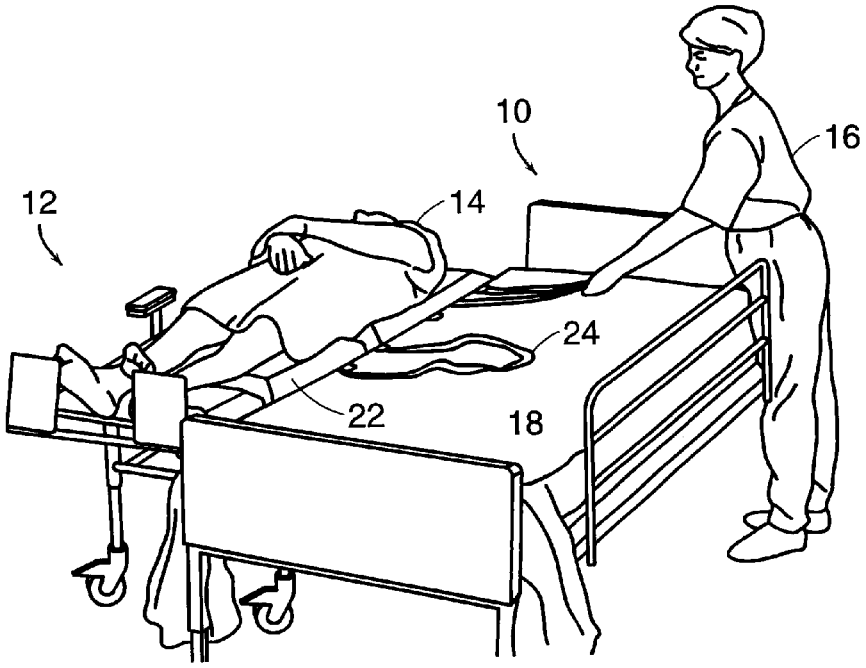
Figure 2C:
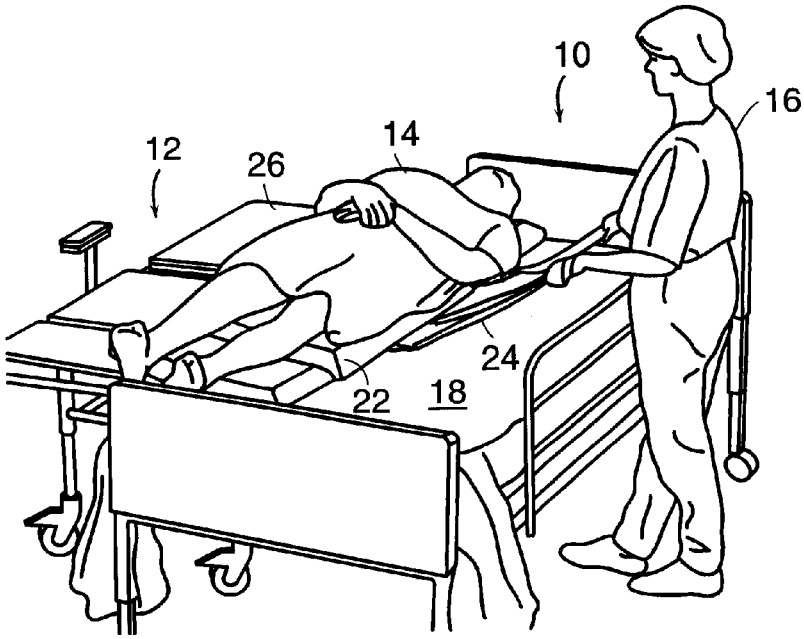
Figure 2D:
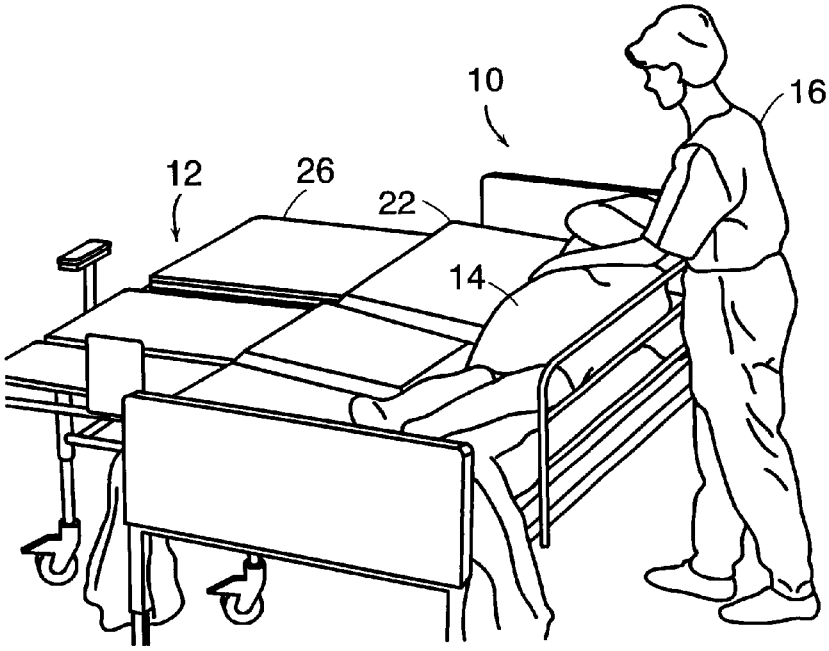
Figure 2E:
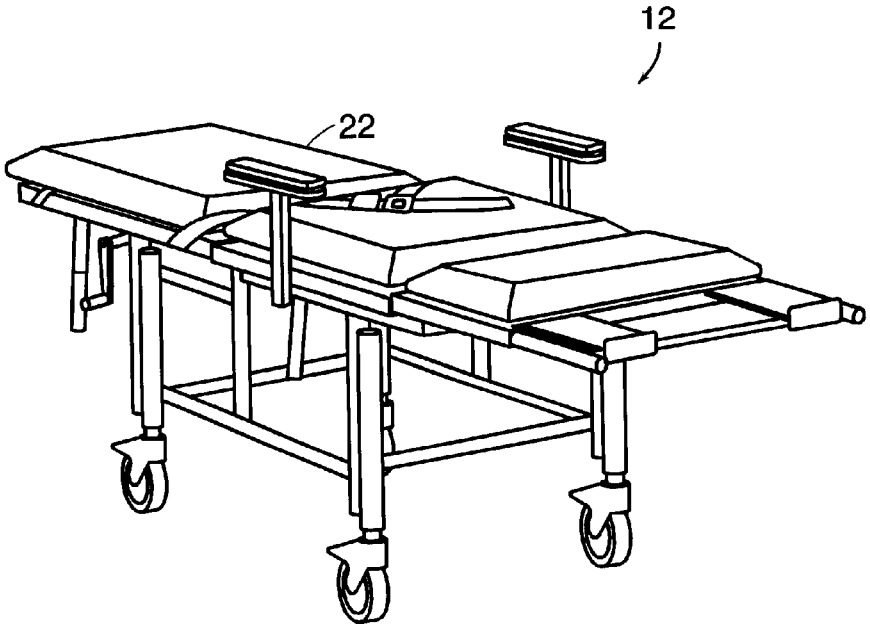
Figure 3:
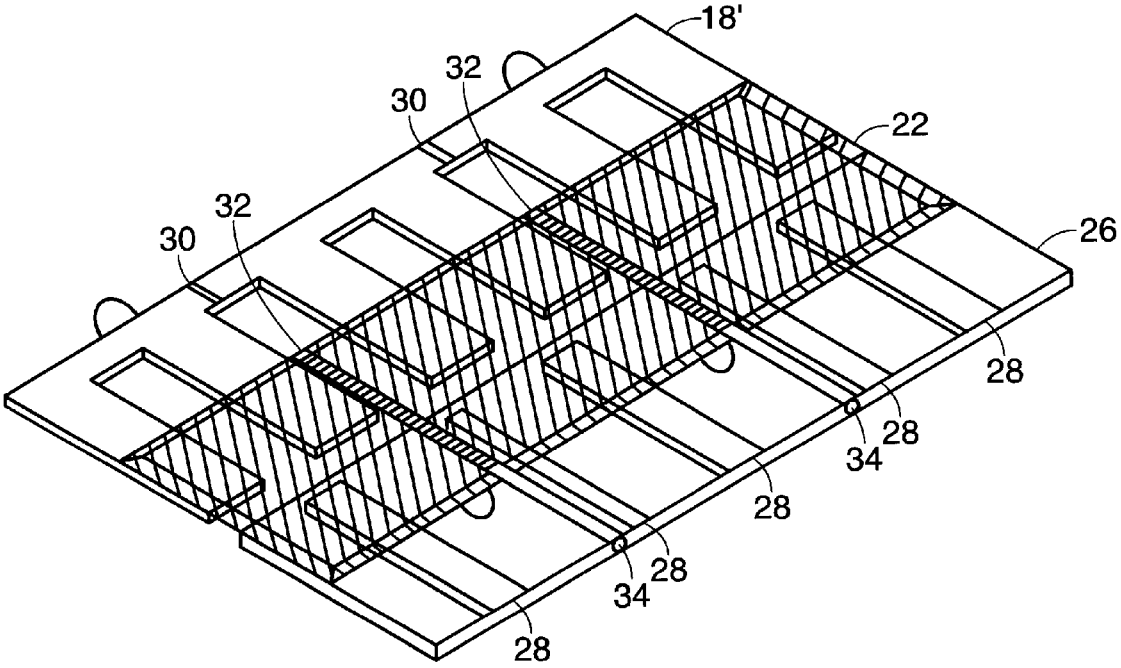
Figure 7A:
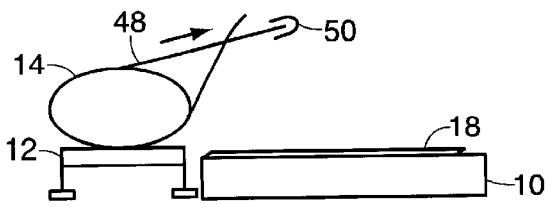
Figure 7B:
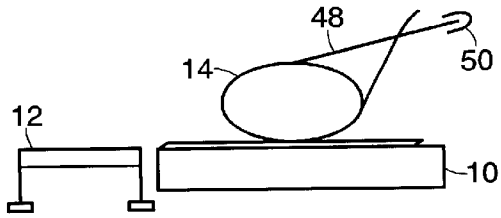
Figure 7C:
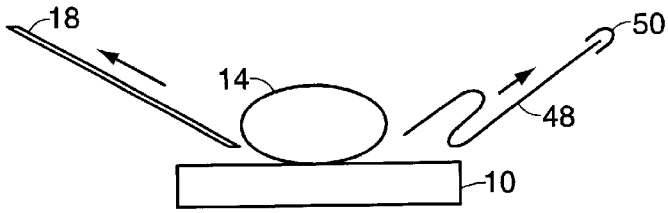
Figure 8:
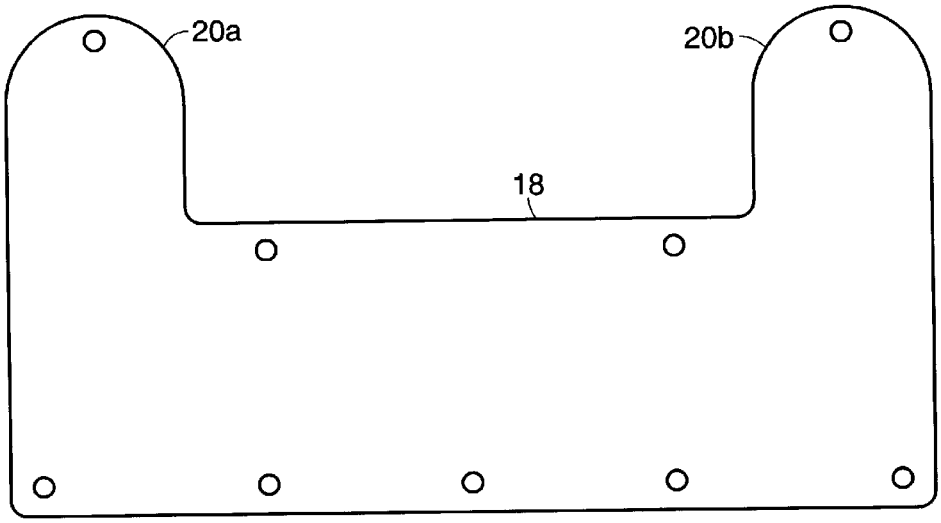
Figure 9A:
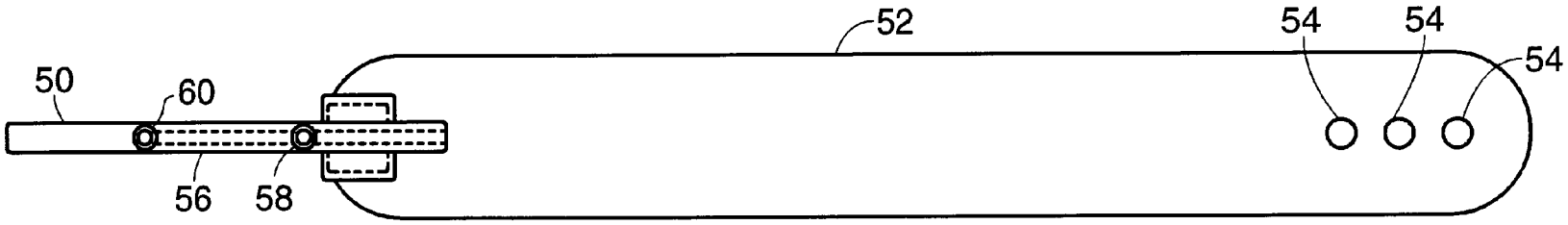
Figure 9B:
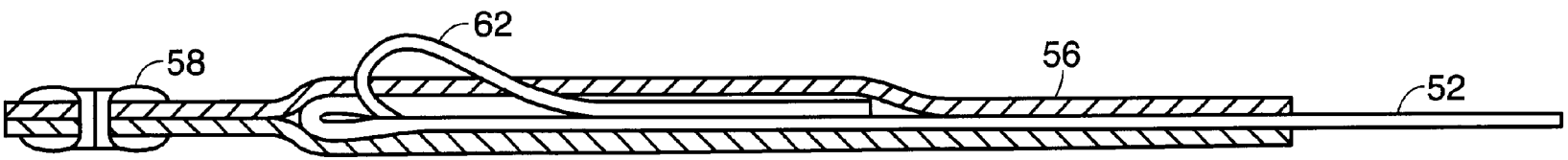
Figure 10A:
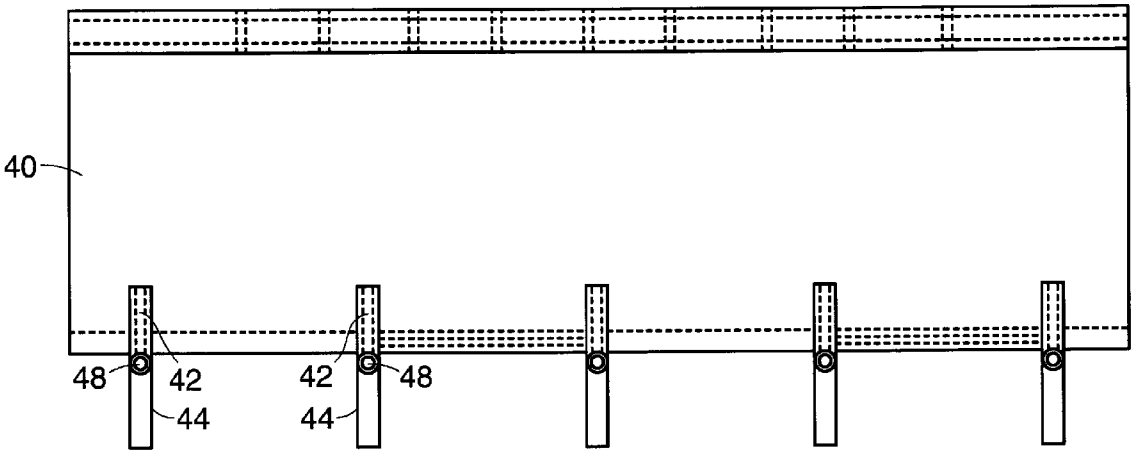
Figure 10B:
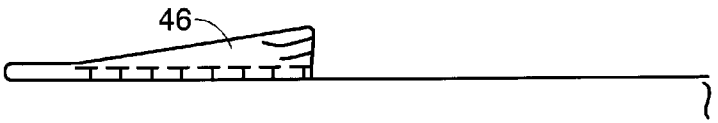
Figure 10C:
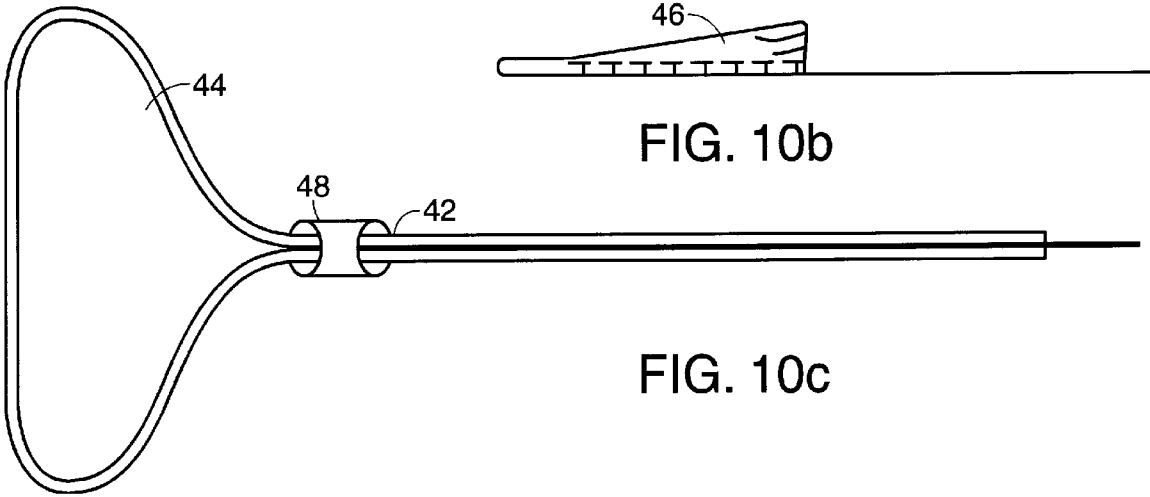

FIGS. 1*a*–1*e* are perspective representations for one embodiment of a method for patient transfer between a bed and a transport device;

FIGS. 2*a*–2*e* are perspective representations of a method for transferring a patient from the transport device back into the bed in accordance with a first embodiment;

FIG. 3 is a perspective view of apparatus which may be utilized in practicing the methods of FIGS. 1 and 2;

FIGS. 4*a*–4*f* are graphic representations of a method of patient transfer from a bed to the transfer device in accordance with a second embodiment of the invention;

FIGS. 5*a*–5*d* are graphic representations of a method of patient transfer from the transport device to a bed in accordance with a second embodiment;

FIGS. 6*a*–6*e* are graphic representations of a method of patient transfer from a bed to the transport device in accordance with a third embodiment of the invention;

FIGS. 7*a*–7*c* are a graphic representation of a method of patient transfer from the transport device to a bed in accordance with a third embodiment of the invention;

FIG. 8 is a top view of a slider board suitable for use in practicing various embodiments of the invention including those shown in FIGS. 1, 2, 6 and 7;

FIGS. 9*a* and 9*b* are a top view and an enlarged side view of a puller strap suitable for use in practicing various embodiments of the invention including the embodiments of FIGS. 5, 6 and 7; and FIGS. 10*a*–10*c* are a top view and enlarged detailed side views, respectively, of a slider sheet suitable for use in practicing various embodiments of the invention, including the embodiments of FIGS. 1, 2, 4, and 5.

DETAILED DESCRIPTION

The basic concept of this invention is to permit a caregiver, whether in an institution such as a hospital or a nursing home, or in a home setting, to be able to move a patient between a bed and a device in which the patient may be moved about without requiring any vertical lifting by the caregiver, and with there being at least one low friction surface under the patient for substantially all movements of the patient of any significant distance during a transfer procedure. The invention thus permits such transfers to be made, even of relatively heavy patients whose physical condition results in their being substantially dead weight, by institutional personnel and/or home caregivers of less than ordinary strength, and who may themselves be aged and somewhat infirm, without risk of back or other injury as a result of the transfer procedure. In the following discussion of specific procedures for implementing this general concept, like reference numerals will be used in the various Figures to designate common elements.

In the Figures, the transfer is shown as being effected between a bed 10 and a gurney-like transport device 12, which device, for preferred embodiments, may be manually raised or lowered relative to bed 10. Device 12 for preferred embodiments also is in three sections, the relative positions of which may be adjusted to convert the device into a reclining chair or upright chair in which the patient may sit and/or be moved. This is accomplished by having a centered seat section with a back section on one side thereof and a leg section on the other side thereof, the back section being raised and the leg section being lowered relative to the seat section by a desired amount to convert the device into a reclining or upright chair. The back and leg sections are preferably linked so as to move together in a desired direction. An example of a device of this type is the Stretchair™ available from MLA Systems, Inc., 8110 Ulmerton Road, Largo, Fla. However, while a device which is convertible to a chair, such as the Stretchair™, is considered preferable in practicing the teachings of this invention because of its ability to provide improved quality of life for the patient, for purposes of practicing the teachings of this invention, all that is required of a device 12 in practicing the teachings of this invention is that it be a second platform which is no higher than the bed for transfers from the bed to the device, and is preferably easily movable. It is also highly advantageous if the height of the device can be adjusted at least through a sufficient range so that the height of the device is slightly less than that of the bed for transfers from the bed to the device, and the height of the device 12 is slightly higher than that of the bed for transfers from the device to the bed.

FIG. 1 shows a first technique for transferring a patient 14 from bed 10 to device 12. Referring first to FIG. 1*a*, caregiver 16 log rolls the patient onto his side facing away from device 12, and a slide board 18 is placed on the bed covering the area of the bed between the patient and the side of the bed from which the patient is to be removed, and preferably at least contacting the patient and/or extending under at least some of the patient. FIG. 8 illustrates one form of slide board suitable for practicing the teachings of this invention, this slide board having a pair of projections 20*a* and 20*b* which, depending on the side from which the board is inserted, will be under the patient's head and legs, respectively, permitting the board to be positioned at least partially under the patient without requiring any lifting of the patient. Slide board 18 may for example be constructed of a polyethylene material or may be coated with a thin coating of a low friction synthetic resin polymer material, for example a Teflon™ coating, depending on application. Slide board 18 may have only a single low friction surface, this being its upper surface, the lower surface being of a higher coefficient of friction so as to adhere to the bed, or both the upper and lower surfaces of the board may be low friction surfaces. For this embodiment of the invention, the top surface of device 12 is a cushion board 22 which is removably secured to device 12. As seen in FIG. 1*b*, the next step in the operation is to remove cushion board 22 from device 12 and to place it on bed 10 over slide board 18 and to push it up against the back of the patient so that, as shown in FIG. 1*c*, the patient may then be easily log rolled onto his back and onto cushion board 22 without requiring any lifting of the patient.

To the extent cushion board 22 is not adjacent the edge of bed 10 over which the patient is to be removed after the patient has been log rolled onto the cushion board, a pair of straps 24 are attached to and extend from the leading edge of the cushion board, and may be used by caregiver 16 to easily slide cushion board 22 across slide board 18 to the edge of the bed. For a preferred embodiment, either all or a selected part of the lower surface of cushion board 22 is also of a low friction material, further facilitating ease of movement of the cushion board across bed 10, and in particular across slide board 18 mounted thereon. However, the low friction bottom surface on cushion board 22 may not be required in all applications.

Figure 1D:
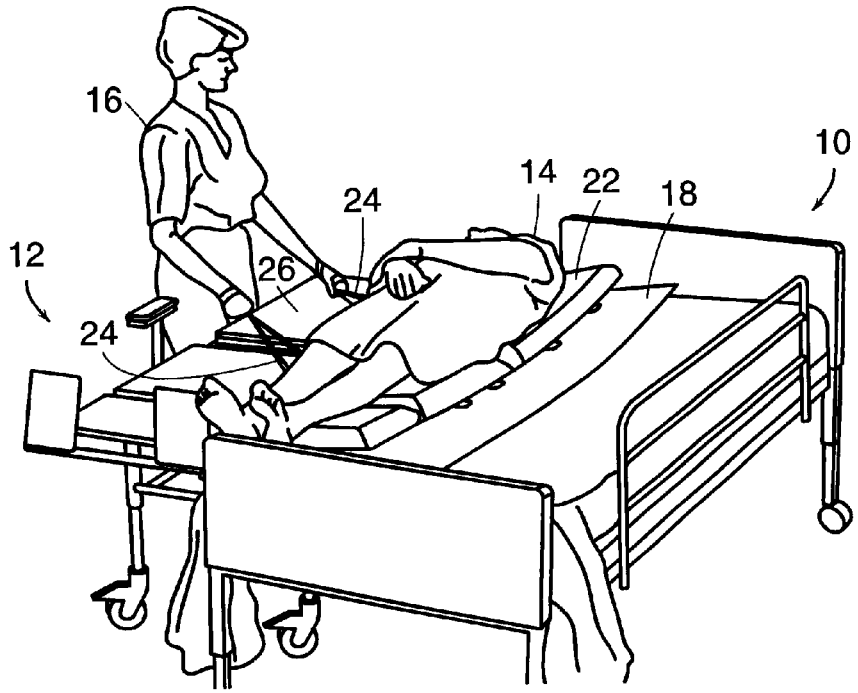
Figure 1E:
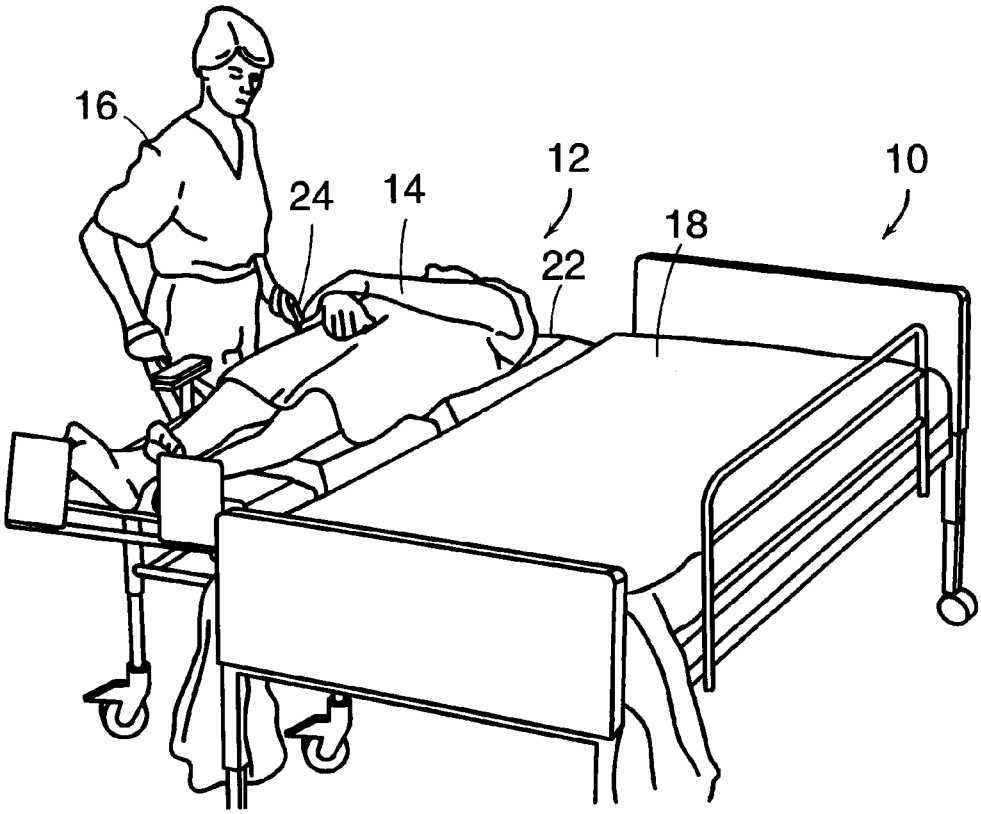

Once the above steps have been completed, device 12 is moved adjacent to the bed as shown in FIGS. 1*d* and 1*e*. It is also preferable that the height of device 10 be either adjusted or adjustable so that the top surface of the device is slightly below the surface of the bed, for example 1 to 2 inches below the surface of the bed. For a preferred embodiment, the height differential between the top of the bed mattress and the top of the device is 1½ inches. Caregiver 16 then moves around to the side of device 12 opposite bed 10, grasps straps 24, and gently pulls on straps 24 to slide the patient across the slide board on bed 10 and down onto device 12. To the extent device 12 is a wheeled transport device, at least the outside wheels of the device are locked so as to prevent movement of the device during the transfer operation. Any arm, side rails, restraints or the like on the adjacent side of both bed 10 and device 12 are also lowered or otherwise moved out of the way. As will be discussed in conjunction with FIG. 3, the upper surface 26 of device 12 under cushion board 22 may be either wholly or partially of a low friction material to facilitate movement of the cushion board across surface 26 to the desired final position shown in FIG. 1*e*. However, the low friction bottom surface of cushion board 22 may be sufficient for this purpose so that two contacting low friction surfaces are not required. Similarly, while the use of a slide board 18 on the bed is preferred, in a situation where the caregiver is a person of ordinary or perhaps slightly greater than ordinary strength, the low friction bottom surface of padded board 22 may alone be sufficient to facilitate movement of the padded board across the upper surface of bed 10. Finally, while for this embodiment a slide board 18 is preferred because of its greater rigidity, a slide sheet to be discussed later may be substituted for the slide board 18 in practicing this embodiment of the invention, and a slide sheet may also be placed on the top of surface 26 rather than having the surface of a low friction material (this not being preferred because of difficulty in subsequently removing the sheet).

Once the transfer has been completed as shown in FIG. 1*e*, the padded board may be secured to device 12 by suitable means known in the art, such as clips, belts, straps, or the like, and, as shown in FIG. 2*a*, the device 12 may be converted to a chair for transporting the patient to a desired location, or such transport may be done with device 12 in a prone or gurney-like position.

Referring to FIG. 2, when it is desired to transfer patient 14 from device 12 back into bed 10, caregiver 16 returns device 12 to the prone position, preferably raises the height of the device so as to be slightly above the height of the bed, preferably 1 to 2 inches higher, with 1½ inches being preferred, moves the device adjacent one side of the bed, removes any arms or other obstructions on adjacent sides of the bed and device and locks at least the outside wheels of the device. The caregiver then moves around to the opposite side of the bed as shown in FIG. 2*b*, grasps straps 24 which have been laid out on the bed, and pulls gently on straps 24 to move padded board 22, with the patient thereon, off of device 12 and onto bed 10. For a preferred embodiment, slide board 18 is placed on bed 10, or a slide sheet is draped on bed 10, prior to moving padded board 22 thereon to facilitate movement of the padded board onto and across the bed. This step would normally be performed in all situations where the caregiver was a person of less than ordinary strength. Once the padded board with the patient thereon is fully on bed 10, the patient is log rolled off of the padded board as shown in FIG. 2*d*, permitting the caregiver to remove both padded board 22 and slide board 18 before rolling the patient back to a desired position. The padded board is then returned to device 12 as shown in FIG. 2*e* in preparation for re-use of the device.

FIG. 3 illustrates a slightly modified configuration for practicing the embodiments of FIGS. 1 and 2, wherein slide board 18' is designed to be stored on device 12 when not in use. For this embodiment, strips 28 of a low friction material, five such strips being shown in FIG. 3, are mounted on surface 26 of device 10 to facilitate movement of padded board 22 over surface 26. Strips 28 raise board 22 slightly above surface 26 permitting slide board 18', which is a modified version of the slide board having a comb-like configuration, to be fitted in and stored in the space between board 22 and surface 26. Where device 12 is adapted to be reconfigured into a chair as shown in FIG. 2*a*, each of slide board 18', padded board 22 and surface 26 are hinged at 30, 32, and 34, respectively, so as to facilitate such reconfiguration. Hinges 30, 32, and 34 may be formed by using belt-like sections fastening the elements together, or could be living hinges or other hinge-type mechanisms known in the art. The top surface of padded board 22 could be cushioned as shown, the cushions being segmented or otherwise divided at the hinges 32, or could be other types of molded or foam surfaces known in the art.

FIG. 4 illustrates an alternative procedure for patient transfer from a bed 10 to a transport device 12. For this embodiment of the invention, patient 14 is initially log rolled (FIG. 4*a*) as for the embodiment of FIG. 1. However, instead of placing slide board 18 and cushion board 22 under the patient as for the embodiment of FIG. 1, a pair of slide sheets 40*t* and 40*b* are placed over bed 10 covering the portion thereof between the leading side of the bed and the patient and extending up to and preferably slightly under the patient. As may be best seen in FIGS. 10*a*–10*c*, each slide sheet has a plurality of straps 42 extending from one side thereof, each of which straps terminates in a handle 44. For a preferred embodiment, the side of each sheet 40 opposite the side to which straps 42 are attached has a plurality of finger pockets 46 formed therein, which pockets are best seen in FIG. 10*b*. Pockets 46, which are optional, facilitate the tucking of a sheet 40 under patient 14. Each of the straps 42 extends across the top of sheet 40, is looped to form handle 44 and then extends across the bottom of the sheet, stitching being provided through both the top and bottom of the strap to secure each strap to sheet 40. A grommet 48 is provided for each strap adjacent the end of sheet 40 to relieve strain on the stitching when the handles are pulled. Sheets 40 may for example be formed of a synthetic fiber such as Dacron™, and may themselves be of a low coefficient of friction material or may be coated on either one or both sides with a low friction coating.

Figure 4A:
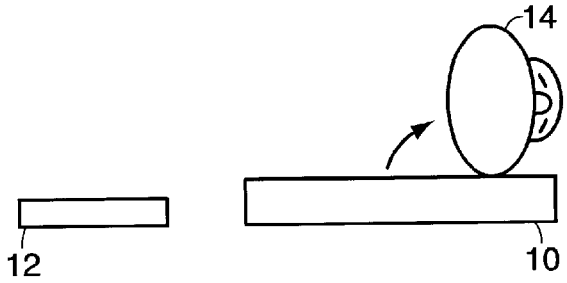
Figure 4B:
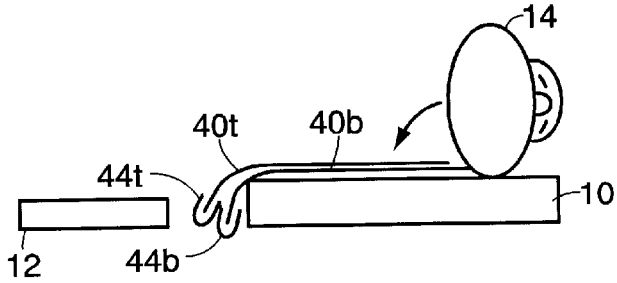
Figure 4C:
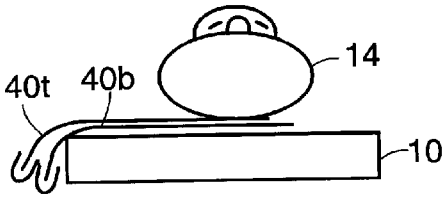
Figure 4D:
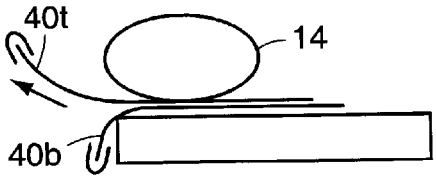
Figure 4E:
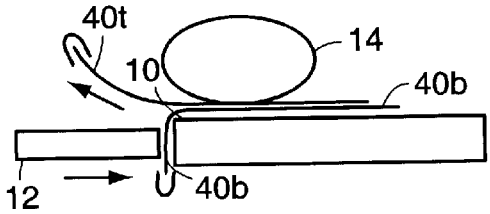

In practicing the step of FIG. 4*b*, sheet 44*b* is first laid on the bed with a low friction surface thereof facing upward and the handle 44*b* thereof extending over the leading edge of the bed, and this sheet is then tucked up against the patient. Sheet 40*t* is then laid on top of sheet 40*b* with a low friction surface thereof in contact with sheet 40*b* and the handle 44*t* thereof extending over the leading edge of the bed, and this sheet is also tucked under the patient as shown in FIG. 4*b*. Once the sheets are in place, the patient is laid down as shown in FIG. 4*c*, with the patient laying on top of sheet 40*t*. The caregiver then grasps two of the handles 44*t*, preferably the handles nearest the chest and calves of the patient, and uses these handles to gently pull sheet 40*t*, with the patient thereon, across the bed until the patient is adjacent the leading edge of the bed as shown in FIG. 4*d*. The movement of sheet 44*t* and the patient laying thereon across bed 10 is facilitated by the low friction contacting surfaces of sheets 40*b* and 40*t*.

Figure 4F:
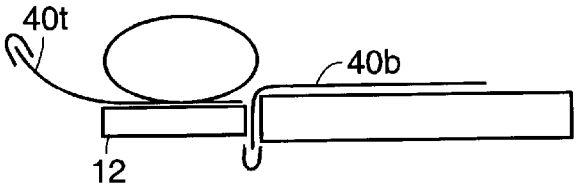

Once the patient is adjacent the edge of the bed, device 12 is positioned adjacent the bed at the height previously discussed and is locked in place. All obstructions between the bed and device are also removed. The caregiver then moves around to the side of device 12 opposite the bed and uses straps 42 to gently pull sheet 40*t* and the patient thereon onto device 12, normally onto the cushions of cushion board 22 on device 12, as shown in FIG. 4*f*. Generally the low friction bottom surface of sheet 40*t* in conjunction with gravity, the patient being moved from the higher bed to the lower device 12, is sufficient to facilitate movement of the patient onto and across the upper surface of device 12 to the desired final position. If necessary, a slide sheet 40 may also be placed across the top surface of device 12 to facilitate movement of slide sheet 40*t* thereacross. However, since the cushions on cushion board 22 on the upper surface of device 12 are typically formed of leather or plastic, materials which are not a high coefficient of friction materials, the low friction bottom surface of sheet 40*t* should normally be sufficient to permit easy movement of patient 14 onto and transport device 12. Once the patient is in the position shown in FIG. 4*f*, the patient may either be log rolled slightly to permit removal of slide sheet 40*t*, the sheet may be left in place until the patient is to be transferred again or the lower portion of the sheet, up to the buttocks, may be removed, the patient moved to a sitting position as shown in FIG. 2*a*, relieving the weight on the back portions of the sheet, and the remainder of the sheet removed as the patient is leaned forward.

Where the technique of FIG. 4 is employed, and sheet 44*t* is left under the patient, the patient may be easily returned to the bed by positioning device 12 on the opposite side of bed 10 from which the patient was removed, laying slide sheet 40*b* over that side of the bed with handle 44*b* extending over the end thereof and the caregiver then moving around to the opposite side of the bed, grasping appropriate handles 44*t* and pulling sheet 40*t* with the patient thereon from device 12 and onto bed 10. The patient can then be log rolled slightly and the two slide sheets removed.

FIG. 5 illustrates an alternative procedure for returning the patient from device 12 to bed 10 which may be easier for inexperienced caregivers since it does not require logrolling of the patient, a maneuver which an inexperienced care giver might have difficulty performing. First, referring to FIG. 5*a*, sheet 40*b* is laid across bed 10 in the same way as for FIG. 4*b*. At least two straps 48 having handles 50 at the ends thereof are wrapped around the patient as shown in FIG. 5*b*. Straps suitable for use as the straps 48 are shown in FIGS. 9*a* and 9*b*. Referring to these figures, each strap 48 has a body portion 52 which may, for example, be approximately 1 foot wide, approximately 5 feet long and approximately 1/16th inches thick. Body portion 52 has a plurality of holes 54 punched in it, which holes are in one end of the strap and are aligned along the center line thereof. Holes 54 may, for example, be spaced approximately 3 inches apart and may be reinforced in suitable ways, such as by stitching, grommets or the like. A handle portion 56 extends from the opposite end of body portion 52 and, as may be best seen in FIG. 9*b*, extends over the top of body portion 52 and beyond and then is looped back under the bottom of the body portion, the handle being double-stitched to the body portion. A portion of the handle extending beyond the end of body portion 52 is also double-stitched between a pair of grommets 58 and 60, the portion of the handle beyond grommet 60 being unstitched to form handle 50. Handle portion 56 is much narrower than body portion 52, being for example 1 inch wide, and is narrower than the diameter of holes 54, which may for example have a diameter of 1-_inches so that handle portion 56, including handle 50, may pass through these holes as shown in FIGS. 5*b* and 5*c*. The portion of handle portion 56 extending beyond the end of body portion 52 to the end of handle 50 may, for example, be 12 to 16 inches. A loop 62 which is wider than handle portion 56, having a 4 inch width for an illustrative embodiment, is sewn into the handle end of body 52, along with handle portion 56, as shown in FIG. 9*b*, loop 62 being a hand-hold useful for positioning to strap.

Figure 5A:
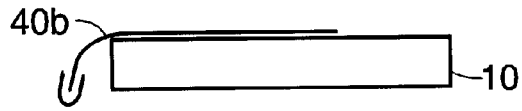
Figure 5B:
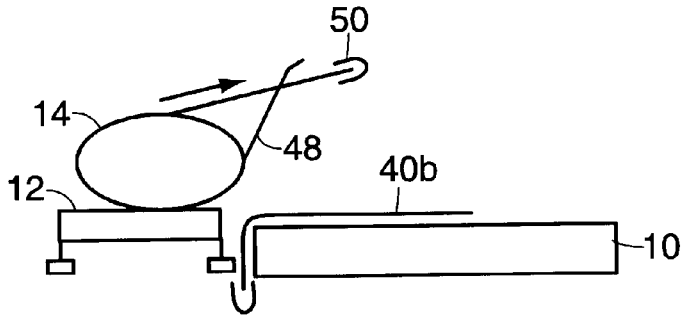
Figure 5C:
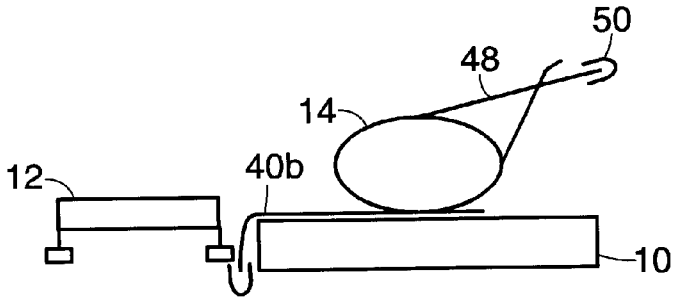
Figure 5D:
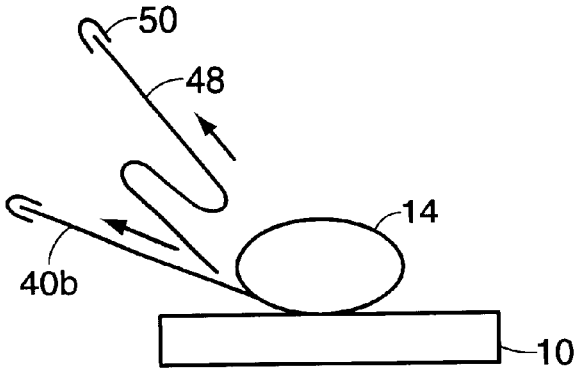
Figure 6A:
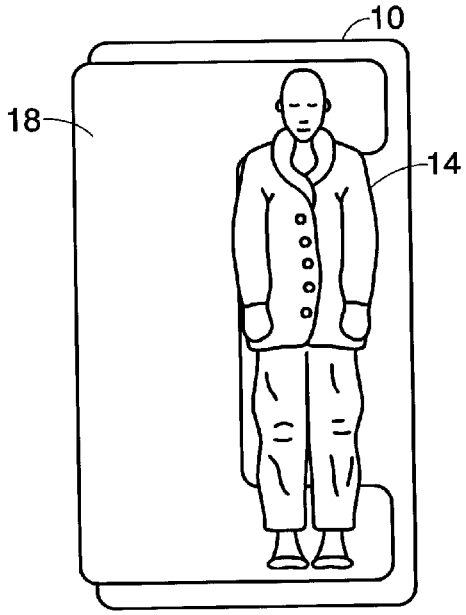
Figure 6B:
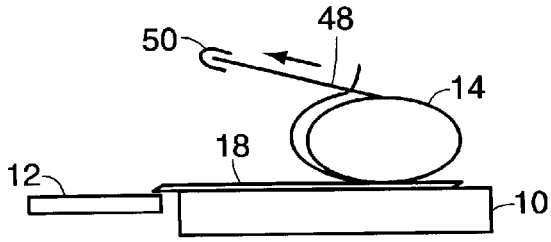
Figure 6C:
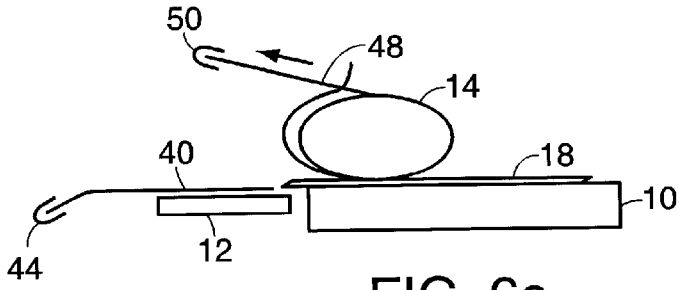
Figure 6D:
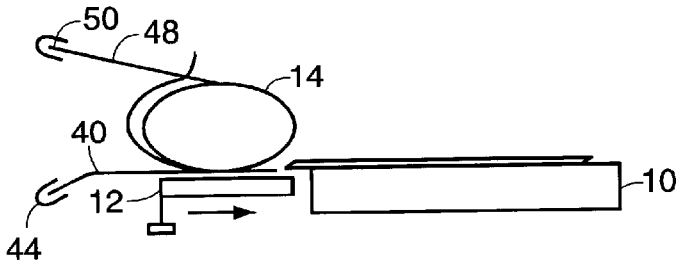
Figure 6E:
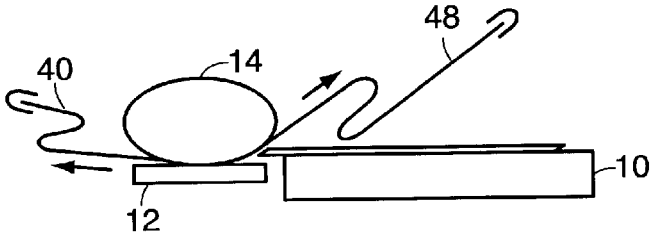

Straps 48 are passed under the patient at places where it is not necessary to lift the patient in order to pass the straps thereunder, for example at the small of the back and under the knees on calves. The strap passed under the small of the back and may then be worked up to be around the chest and the second strap may be positioned above or below the patient's knees or at the calves. The upper part of the upper strap is then laid over the patient's arm and body. The lower part of the strap is then raised and the handle portion in the upper part is pulled through a convenient hole in the lower part as shown in FIG. 5*b*. The caregiver then goes around to the side of bed 10 opposite device 12, grasps the handles 50 of each strap and uses the straps to gently pull the patient from the device 12 onto slide sheet 40*b* on the bed and across the bed to the desired position, as shown in FIG. 5*c*. Since, as for the prior embodiments, the upper surface of device 12 is slightly above the surface of bed 10, gravity should be sufficient to permit movement of the patient from device 12 onto slide sheet 40*b* and the low friction surface of sheet 40*b* should be sufficient to permit movement of the patient across bed 10 to the desired position shown in FIG. 5*c*. Alternatively, a slide sheet or slide board may be inserted under the patient on device 12 to facilitate movement of the patient off the device, although the relatively low friction of materials generally used for the cushions on device 12 should normally make this unnecessary. As for other embodiments, a slide board 18 may be substituted for the slide sheet 40*b* for this embodiment. Once the patient is in the position shown in FIG. 5*c*, the patient is log rolled to the right to permit removal of slide sheet 40*b* and handle portion 56 is pulled out of the opening 54 in which it has been inserted and the straps are moved to a position where they can be easily removed.

FIG. 6 illustrates still another embodiment of the invention for transferring a patient from bed 10 to device 12. Referring to FIG. 6*a*, board 18 is positioned on bed 10 at least partially under patient 14 just as for FIG. 1*a*. In FIG. 6*b*, straps 48 are wrapped around patient 14 in the manner previously described and positioned adjacent the patient's chest and lower leg. A slide sheet 40 is then positioned on device 12 and the device moved adjacent the side of the bed as shown in FIG. 6*c*. Handles 50 on straps 48 are then pulled to pull the patient across the low friction slide board to the edge of the bed as shown in FIG. 6*c*. The caregiver then moves around to the side of device 12 opposite bed 10 and grasps handles 50 on the strap to pull the patient onto slide sheet 40 on device 12. This final movement is facilitated by the slide board 18, the slide sheet 40 and gravity, device 12 being slightly lower than bed 10. Once the patient is positioned as shown in FIG. 6*d*, the slide sheet may either be left on device 12 as previously discussed or the patient log rolled slightly to permit its removal as shown in FIG. 6*e*. Straps 48 are removed in the manner previously discussed. Alternatively, where the patient will be moved again shortly, straps 48 may be left in place.

FIGS. 7*a*–7*c* illustrate an alternative procedure for returning the patient from device 12 to bed 10, this procedure being substantially identical to the procedure discussed in conjunction with FIG. 5, except that a slider board 18 is positioned on bed 10 rather than a slider sheet 40*b*.

While three basic procedures for patient transfer in each direction between a bed and a transport device have been discussed above, and numerous variations have been discussed for these procedures, the procedures are for purposes of illustration only. Similarly, while various embodiments have been disclosed for slide boards, padded boards, slide sheets and straps to be used in implementing these various methods, it is to be understood that the various boards, sheets and straps disclosed are for purposes of illustration only and that other boards, sheets or other suitable low friction surfaces and that other straps may be utilized in implemented the various methods of this invention and that additional variations are possible for facilitating the transfer operations. For example, while FIG. 3 shows one way of storing a slide board 18 on device 12, the board could also be hinged to form for example three sections of substantially equal size and folded for storage or, if thin enough, could be rolled up for storage. Further, while the discussion above has been with respect to patient transfer, the invention can be utilized in any situation where a body is to be manually transferred between two substantially horizontal platforms/surfaces. Thus, while the invention has been particularly shown and described above with reference to preferred embodiments, the foregoing and other changes in form and detail may be made thereon by one skilled in the art without departing from the spirit and scope of the invention which is to be defined only by the appended claims.

What is claimed is:

1. A method of transferring a person lying on a first platform of a selected height to a second platform of a height no higher then that of said first platform, the method including the steps of:

a) mounting a first component having a low friction upper surface on said first platform over at least most of the portion of said first platform between the person and a first side of said first platform over which transfer will occur, at least some portion of said low friction surface extending under the person;

b) mounting a second component having a low friction lower surface over at least a portion of said first component and extending under the person, said second component having at least two spaced straps extending in a first direction from said second component toward said first side, at least one of said first and second components being at least semi-rigid;

c) pulling said straps in said first direction to move said second component, and the person thereon over said first component to said first side of said first platform;

d) moving said second platform adjacent the first side of said first platform, step (d) being performable at any point in the process prior to step (d); and e) continuing to pull on said straps from a side of said second platform opposite that adjacent said first platform to move the second component and the person thereon from the first platform to the second platform.

2. A method as claimed in claim 1 wherein said second component is at least semi-rigid.

3. A method as claimed in claim 2 wherein said second component is a board having a low friction bottom surface normally forming the top surface of said second platform, said straps being attached to said board and extending in said first direction therefrom, step (b) including moving said board from said second platform to said first platform over said first component, and log rolling said person onto said board; said board with the person thereon being moved during steps (c) and (e).

4. A method as claimed in claim 2 wherein said second component is a board having said straps extending therefrom, step (b) including log rolling said person onto said board, and wherein steps (c) and (e) include moving said board with the person thereon.

5. A method as claimed in claim 1 including the step performed at a point in the method before step (e) of adjusting the height of at least one of the platforms so that the second platform is slightly lower than the first platform.

6. A method as claimed in claim 5 wherein said second platform is approximately 1" to 2" lower than said first platform.

7. A method of transferring a person lying on a first platform of a selected height to a second platform of a height no higher then that of said first platform, the method including the steps of:

a) providing a low friction surface under the person for at least a portion of the travel path of the patient between the person's initial position on said first platform and the person's desired final position on said second platform, said low friction surface being under the person for at least any extended portion of the travel path where the person is over a platform;

b) mounting a second component having a low friction lower surface over at least a portion of said first component and extending under the person, said second component having at least two spaced straps extending in a first direction from said second component toward said first side, at least one of said first and second components being at least semi-rigid;

c) moving said second platform adjacent said first platform, step (c) being performed at a point in the method prior to step (d); and d) pulling on said straps in said first direction from a side of said second platform opposite that adjacent said first platform to move the second component and the person thereon from the first platform to the desired final position on the second platform.

8. A method as claimed in claim 7 including the step performed at a point in the method before step (d) of adjusting the height of at least one of the platforms so that the second platform is slightly lower than the first platform.

9. A method as claimed in claim 8 wherein said second platform is approximately 1" to 2" lower than said first platform.

10. A method as claimed in claim 9 wherein said second component is a board having a low friction surface on its side opposite that on which the person is positioned, step (a) including positioning the person on the board, said straps being fixed to and extending from said board.

11. A slide board for use in moving a person lying on a first platform to a second platform, said board being substantially flat, having at least one low friction surface, being of a length at least as great as the height of a majority of persons with whom it will be used, having a width to cover a distance over which a person is to be moved on one of said platforms, and having at least one projection positioned to fit under a substantially non-weight bearing area of a prone person.

12. A board as claimed in claim 11 wherein said projections fit under the head and feet areas of the person.

13. A board as claimed in claim 11 wherein said board is bendable at least two places along its length.

14. A puller strap for use in moving a person from a first platform to a second platform, the strap including a body portion having a length greater than the maximum circumference of a normal person to be moved, a first width, a plurality of holes formed near one end thereof, which holes have a selected width and are aligned along the length of the body, and a handle portion extending from the end of said body opposite said one end thereof, said handle portion having a width less than said selected width of the holes, being secured to said body portion on one end thereof and having a handle formed therein at the opposite end thereof.

15. A strap as claimed in claim 14 wherein said handle portion includes a strap which passes over said body portion for a selected length, is looped to form said handle, and extends back under said body portion for said selected length, said selected lengths of strap over and under said body portion being sewn to the body portion to secure the strap thereto.

16. A strap as claimed in claim 15 including a loop secured to said body portion in the area of said selected length of strap.

17. A slide sheet for use in moving a person lying on a first platform to a second platform, the sheet having at least one low friction surface, being of a length at least as great as the height of a majority of persons with whom it will be used, having a width to cover a distance over which a person is to be moved on one of said platforms, having at least two spaced, hand straps extending from at least one side thereof, and including a plurality of finger pockets formed on a side of said sheet opposite a side from which said hand straps extend, said pockets being positioned to facilitate moving said opposite side said sheet under a person.

* * * * *